US010927588B2

(12) United States Patent
Kashiwabara et al.

(10) Patent No.: US 10,927,588 B2
(45) Date of Patent: Feb. 23, 2021

(54) WINDOW REGULATOR

(71) Applicant: Johnan Manufacturing Inc., Nagano (JP)

(72) Inventors: Hideo Kashiwabara, Nagano (JP); Hiroki Shimizu, Nagano (JP); Yukihide Yamazaki, Nagano (JP); Wataru Murata, Nagano (JP)

(73) Assignee: JOHNAN MANUFACTURING INC., Nagano (JP)

( * ) Notice: Subject to any disclaimer, the term of this patent is extended or adjusted under 35 U.S.C. 154(b) by 98 days.

(21) Appl. No.: 16/275,909

(22) Filed: Feb. 14, 2019

(65) Prior Publication Data

US 2019/0257133 A1 Aug. 22, 2019

(30) Foreign Application Priority Data

Feb. 22, 2018 (JP) ..... JP2018-029820

(51) Int. Cl.
*E05F 15/689* (2015.01)
*E05F 11/48* (2006.01)

(52) U.S. Cl.
CPC ..... *E05F 15/689* (2015.01); *E05F 11/486* (2013.01); *E05Y 2900/55* (2013.01)

(58) Field of Classification Search
CPC ..... E05F 11/483; E05F 11/486; E05F 11/385; E05F 11/382; E05F 11/481; E05F 11/488; E05F 15/689; E05Y 2900/55; E05Y 2201/684; E05Y 2201/654; E05Y 2201/66
See application file for complete search history.

(56) References Cited

U.S. PATENT DOCUMENTS 9,163,448 B2 * 10/2015 Imaoka ..... E05F 15/689
9,255,433 B2 * 2/2016 Imaoka ..... E05F 11/485
9,580,953 B1 * 2/2017 Matsushita ..... B60J 1/08
(Continued)

FOREIGN PATENT DOCUMENTS

DE 202011100077 U1 7/2012
JP 2015-048605 A 3/2015
(Continued)

OTHER PUBLICATIONS

Office Action issued in the corresponding JP Patent Application No. 2018-029820 dated Jan. 28, 2020.
(Continued)

*Primary Examiner* — Justin B Rephann
(74) *Attorney, Agent, or Firm* — Roberts Calderon Safran & Cole P.C.

(57) ABSTRACT

A window regulator includes a guide rail provided along an ascending/descending direction of a window of a vehicle, a carrier plate that slides on the guide rail and moves together with the window, cables that pulls the carrier plate, a drum that is rotationally driven by a motor, and a housing that includes a drum housing accommodating the drum and a motor housing fixed to the drum housing and accommodating a portion of the motor. The drum housing includes a fitting portion including a fitting hole to insert a lower end of the guide rail and a fastening hole used to fasten the motor housing. The fastening hole of the drum housing is provided at a position overlapping the guide rail in a longitudinal direction of the vehicle.

3 Claims, 7 Drawing Sheets

(56) References Cited

U.S. PATENT DOCUMENTS

| | | | | |
|---|---|---|---|---|
| 10,017,979 | B2 * | 7/2018 | Ando | E05D 15/165 |
| 10,190,352 | B2 | 1/2019 | Imaoka | |
| 10,711,502 | B2 * | 7/2020 | Yokoyama | E05D 15/165 |
| 2011/0283622 | A1 * | 11/2011 | Yoshida | E05F 15/689 49/349 |
| 2013/0227889 | A1 * | 9/2013 | Matsushita | E05F 11/382 49/352 |
| 2014/0007507 | A1 * | 1/2014 | Umemura | E05F 11/486 49/349 |
| 2014/0109481 | A1 * | 4/2014 | Umemura | E05F 11/483 49/352 |
| 2015/0101252 | A1 * | 4/2015 | Baba | E05F 15/689 49/349 |
| 2017/0030130 | A1 * | 2/2017 | Ando | E05F 11/483 |
| 2017/0268273 | A1 * | 9/2017 | Matsushita | E05F 11/382 |
| 2018/0112451 | A1 | 4/2018 | Imaoka | |

FOREIGN PATENT DOCUMENTS

| | | | |
|---|---|---|---|
| JP | 2015-121059 | A | 7/2015 |
| WO | 2016171200 | A1 | 10/2016 |

OTHER PUBLICATIONS

Office Action issued in the corresponding JP Patent Application No. 2018-029820 dated Feb. 25, 2020.
Office Action issued in the corresponding Chinese Patent Application No. 201910129265.4 dated May 29, 2020.

* cited by examiner

WINDOW REGULATOR

CROSS-REFERENCE TO RELATED APPLICATIONS

The present application is based on Japanese patent application No. 2018-029820 filed on Feb. 22, 2018, the entire contents of which are incorporated herein by reference.

BACKGROUND OF THE INVENTION

1. Field of the Invention

The invention relates to a window regulator.

2. Description of the Related Art

A window regulator is known which is provided with a guide rail provided along an ascending/descending direction of a window, a carrier plate sliding on and guided by the guide rail, wires for pulling the carrier plate, and a housing provided at a lower end of the guide rail to hold a motor and a drum (see, e.g., JP 2015/48605 A).

SUMMARY OF THE INVENTION

In recent years, with reduction in thickness and weight of vehicle door, a housing space provided in door panel to house a window regulator has become narrower. Thus, there is a demand for a small and light window regulator.

It is an object of the invention to provide a window regulator that can be reduced in weight.

According to an embodiment of the invention, a window regulator comprises:

a guide rail provided along an ascending/descending direction of a window of a vehicle;

a carrier plate that slides on the guide rail and moves together with the window;

cables that pulls the carrier plate;

a drum that is rotationally driven by a motor; and a housing that comprises a drum housing accommodating the drum and a motor housing fixed to the drum housing and accommodating a portion of the motor, wherein the drum housing comprises a fitting portion comprising a fitting hole to insert a lower end of the guide rail and a fastening hole used to fasten the motor housing, and wherein the fastening hole of the drum housing is provided at a position overlapping the guide rail in a longitudinal direction of the vehicle.

Effects of the Invention

According to an embodiment of the invention, a window regulator can be provided that can be reduced in weight.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Summary of the Embodiment

Figure 1:
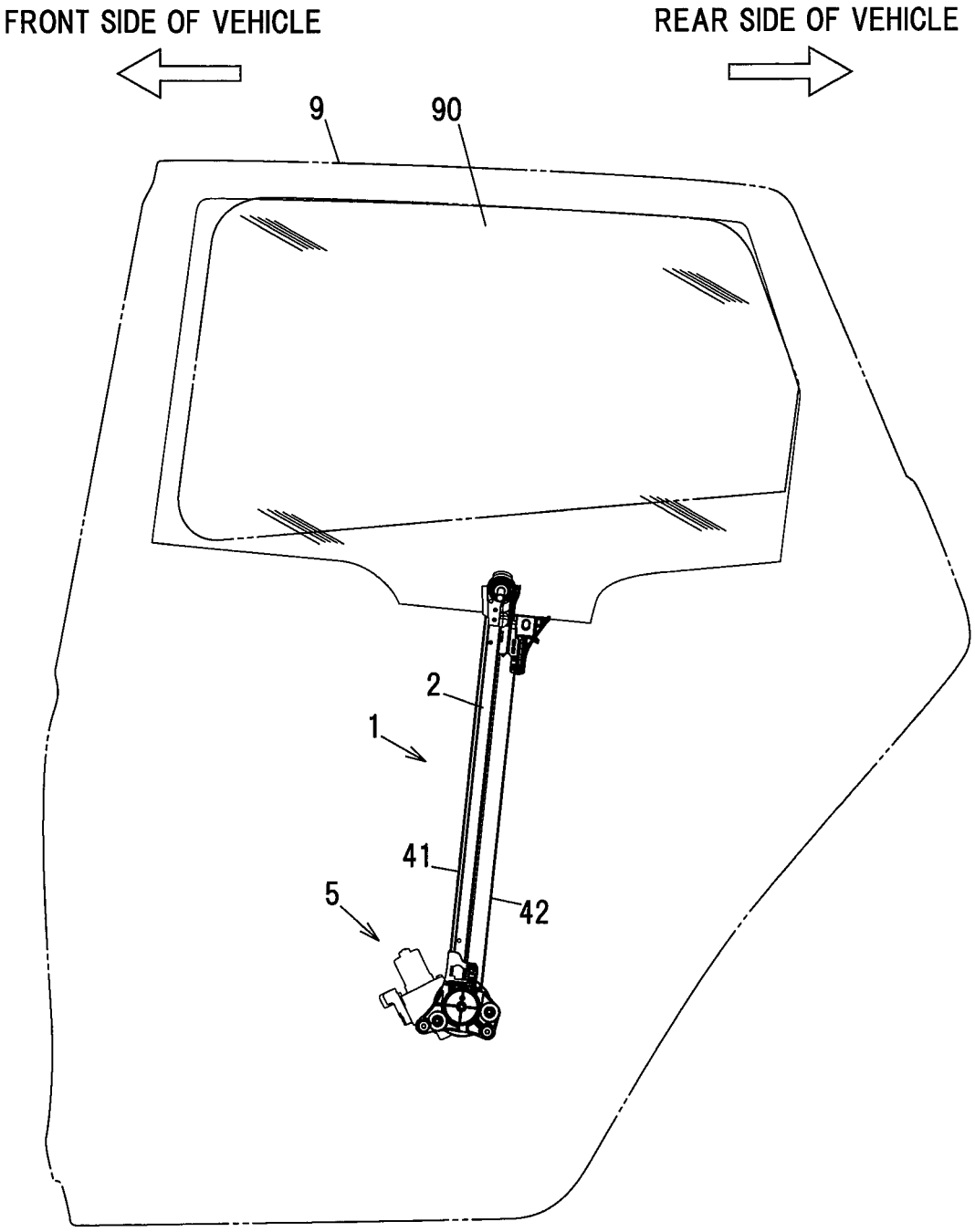
FIG. 1 is a general schematic diagram illustrating a window regulator in an embodiment and a vehicle door mounting the window regulator.

A window regulator 1 in the present embodiment is provided with a guide rail 2 provided along an ascending/descending direction of a window 90 of a vehicle, a carrier plate 3 that slides on the guide rail 2 and moves together with the window 90, cables (41, 42) that pulls the carrier plate 3, a drum 52 that is rotationally driven by a motor 51, and a housing 50 that includes a drum housing 53 accommodating the drum 52 and a motor housing 54 fixed to the drum housing 53 and accommodating a portion of the motor 51, wherein the drum housing 53 includes a fitting portion 532 including a fitting hole 532*a* to insert a lower end of the guide rail 2 and a fastening hole (533*a*) used to fasten the motor housing 54, and wherein the fastening hole (533*a*) of the drum housing 53 is provided at a position overlapping the guide rail 2 in a longitudinal direction of the vehicle.

The drum housing 53 of the window regulator 1 can be reduced in weight as compared to the configuration in which a fastening hole used for fastening the motor housing is provided at a position not overlapping the guide rail in the longitudinal direction of the vehicle.

Embodiment

The window regulator in the present embodiment is a device for raising and lowering a window on, e.g., an automobile door and is installed on a door panel of an automobile.

General Configuration of the Window Regulator 1

Figure 2:
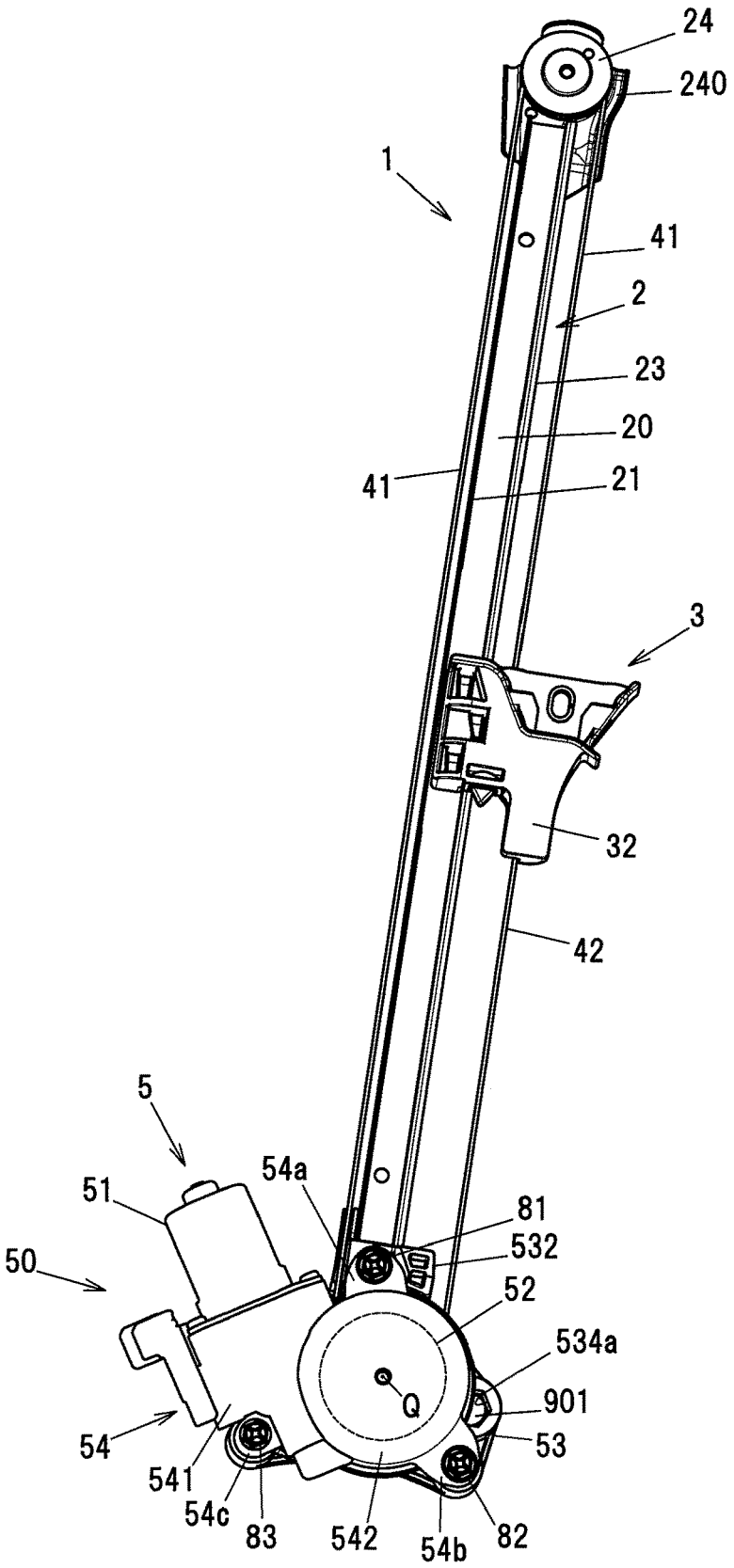
FIG. 2 is a front view showing a configuration of the window regulator of the embodiment.
Figure 3:
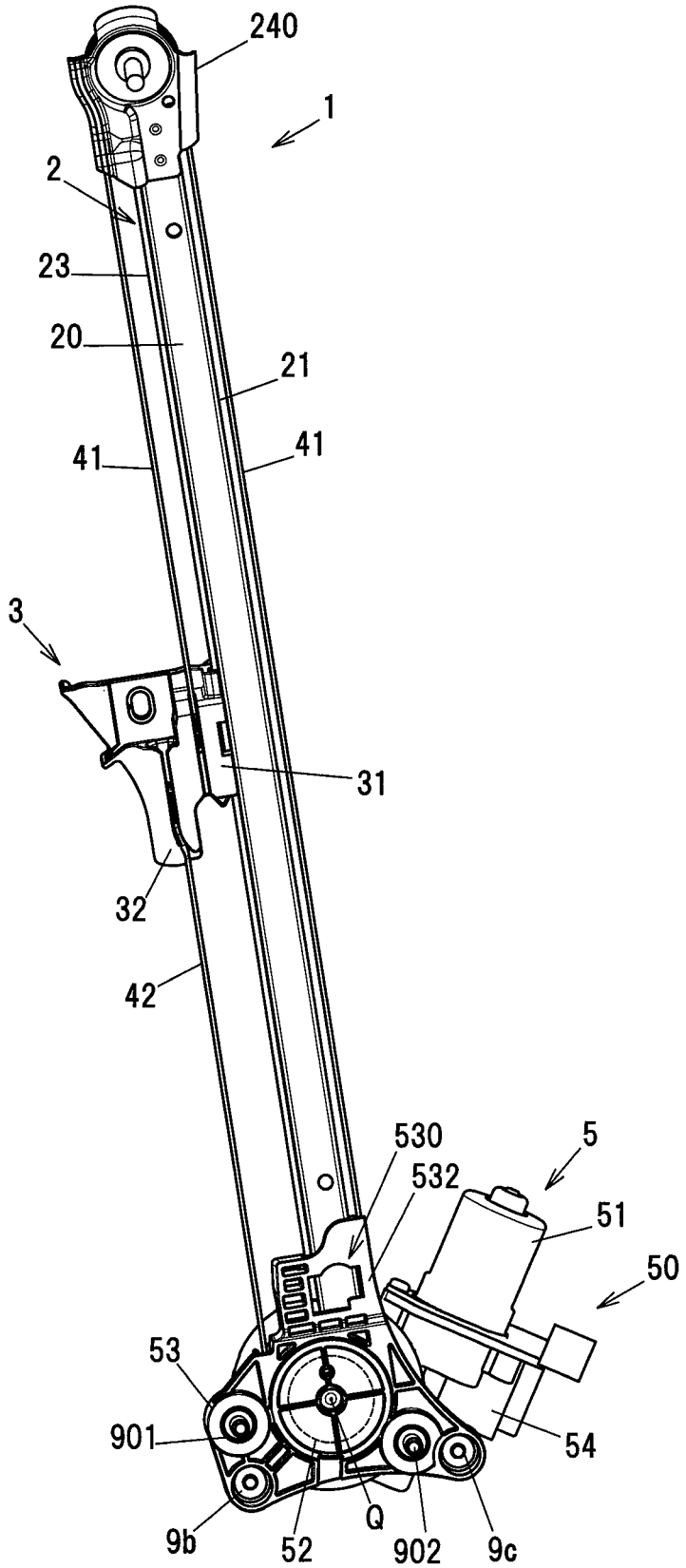
FIG. 3 is a back view showing the configuration of the window regulator of the embodiment.
Figure 4:
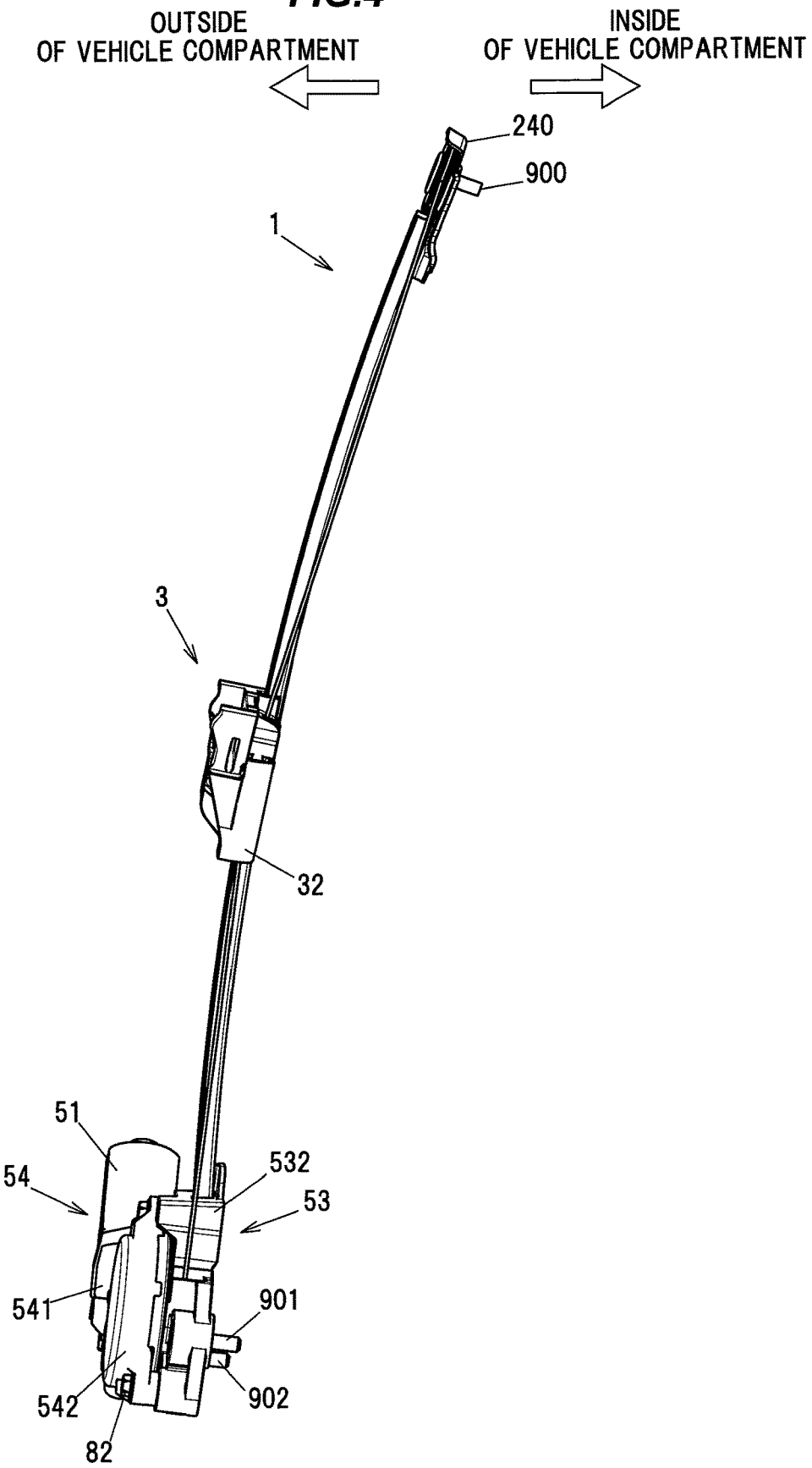
FIG. 4 is a side view showing the configuration of the window regulator of the embodiment.

FIG. 1 is a general schematic diagram illustrating the window regulator 1 in the present embodiment and a door 9 of a vehicle mounting the window regulator 1. FIG. 2 is an overall view showing a configuration of the window regulator 1. In FIG. 1, the window 90 is in a fully-closed state, and the door 9 and a window frame are indicated by dash-dot-dot lines. In addition, in FIG. 1, the left side of the paper is the front side in the vehicle longitudinal direction and the right side of the paper is the rear side in the vehicle longitudinal direction. FIG. 2 is an overall view showing a configuration of the window regulator 1 and is a front view when viewing the inside of the vehicle compartment from the outside of the vehicle compartment in a direction along the width of the vehicle. FIG. 3 is an overall view showing the configuration of the window regulator 1 and is a back view when viewing the outside of the vehicle compartment from the inside of the vehicle compartment in the direction along the width of the vehicle. FIG. 4 is an overall view showing the configuration of the window regulator 1 and is a side view when viewed in the vehicle longitudinal direction.

As shown in FIGS. 1 and 2, the window regulator 1 is generally composed of the guide rail 2 which is housed in a door panel (not shown) provided on the door 9 of the vehicle and is arranged along an ascending/descending direction of the window 90, the carrier plate 3 which slides on the guide rail 2 and moves together with the window 90, an ascending-side cable 41 and a descending-side cable 42 which pull the carrier plate 3, and a drive unit 5 which generates a driving force for taking up and feeding out the ascending-side cable 41 and the descending-side cable 42.

Configuration of the Guide Rail 2

The guide rail 2 is formed by bending a long metal plate at a predetermined curvature and is arranged so as to tilt to the rear side in the vehicle longitudinal direction with respect to the door 9. The guide rail 2 integrally has a flat plate portion 20 extending in a longitudinal direction thereof, first and second side plate portions 21 and 22 provided upright from both edges of the flat plate portion 20 which are the edges in a width direction orthogonal to the longitudinal direction thereof, and a flange portion 23 projecting from an end of the second side plate portion 22 toward the side opposite to the flat plate portion 20 (see FIG. 6 which is described later). Of the first and second side plate portions 21 and 22, the first side plate portion 21 is a side plate portion arranged on the front side in the vehicle longitudinal direction. In FIG. 2, the first and second side plate portions 21 and 22 protrude toward the near side (reader's side) of the paper.

Configuration of the Carrier Plate 3

The carrier plate 3 is a plate-shaped member formed of, e.g., a resin such as polyacetal. The carrier plate 3 has an ascending-side wire end housing portion 31 and a descending-side wire end housing portion 32. The ascending-side wire end housing portion 31 houses an ascending-side wire end (not shown) formed at an end of the ascending-side cable 41. The descending-side wire end housing portion 32 houses a descending-side wire end (not shown) formed at an end of the descending-side cable 42.

Configuration of the Ascending-Side Cable 41 and the Descending-Side Cable 42

The ascending-side cable 41 is coupled to the carrier plate 3 at one end, turns at a pulley 24 provided at the top end of the guide rail 2, and is coupled to the drum 52 of the drive unit 5 (described later) at the other end. The descending-side cable 42 is coupled to the carrier plate 3 at one end and is coupled to the drum 52 at the other end. The pulley 24 is shaft-supported by a pulley bracket 240 which is fixed to an upper end of the guide rail 2. The pulley bracket 240 is fixed to a door panel by a bracket bolt 900 (shown in FIG. 4).

The ascending-side cable 41 and the descending-side cable 42 are routed so as not to overlap the guide rail 2 when viewed in a direction along a rotational axis Q of the drum 52.

Configuration of the Drive Unit 5

The drive unit 5 has the motor 51 with reducer, the cylindrical drum 52 (indicated by a dashed line in FIGS. 2 and 3) and the housing 50. The drum 52 is rotationally driven by the motor 51 and rotates to take up and feed out the ascending-side cable 41 and the descending-side cable 42. The housing 50 is provided at a lower end of the guide rail 2, holds the motor 51, and is composed of the drum housing 53 accommodating the drum 52 and the motor housing 54 fixed to the drum housing 53 and accommodating a portion of the motor 51.

The motor 51 is held by the motor housing 54 and is inclined by a predetermined angle about the rotational axis Q of the drum 52. The reducer constructed from a worm wheel, etc., is coupled to and meshes with the output shaft of the motor 51. The reducer is housed in the motor housing 54.

The motor housing 54 has a motor housing portion 541 and a drum cover 542. The motor housing portion 541 houses the reducer which is a portion of the motor 51, and the drum cover 542 covers an opening of a drum housing portion 531 (see FIG. 5) of the drum housing 53 (described later).

The motor housing 54 also has first to third fixed portions 54*a* to 54*c* which are fixed to the drum housing 53. Bolt insertion holes for inserting bolts 81 to 83 used to fasten the motor housing 54 to the drum housing 53 are respectively formed on the first to third fixed portions 54*a* to 54*c*.

As shown in FIG. 4, the drum housing 53 is located on the vehicle compartment side in the vehicle width direction and the motor housing 54 is located on the outer side in the vehicle width direction with respect to the vehicle compartment. The lower end of the guide rail 2 is fitted to the drum housing 53. The drum housing 53 is fixed to the door panel (not shown) by panel attachment bolts 901 and 902.

Details of the Drum Housing 53

Figure 5A:
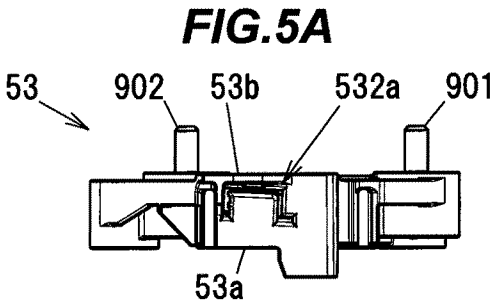
FIGS. 5A to 5F are plan views showing a configuration example of a drum housing.
Figure 5B:
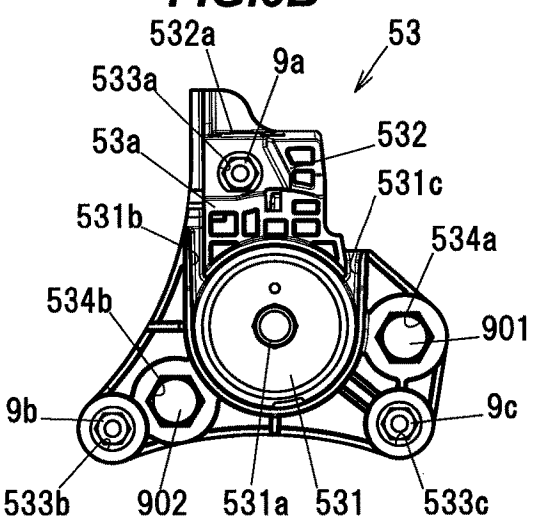
Figure 5E:
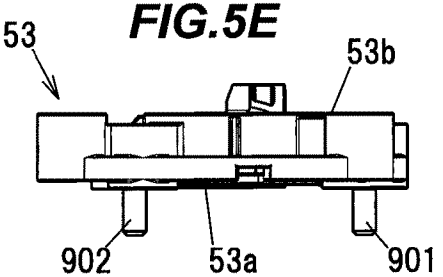
Figure 5C:
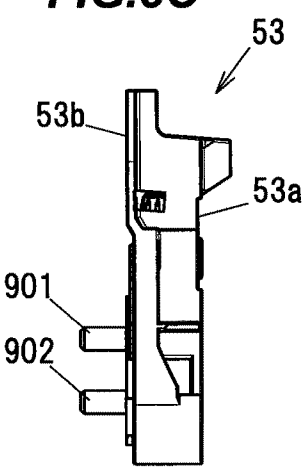
Figure 5D:
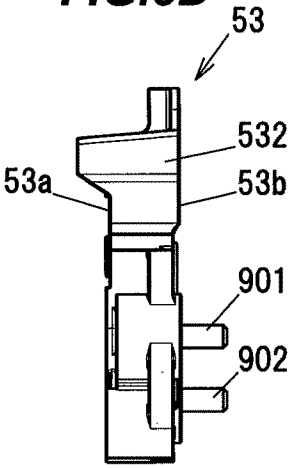
Figure 5F:
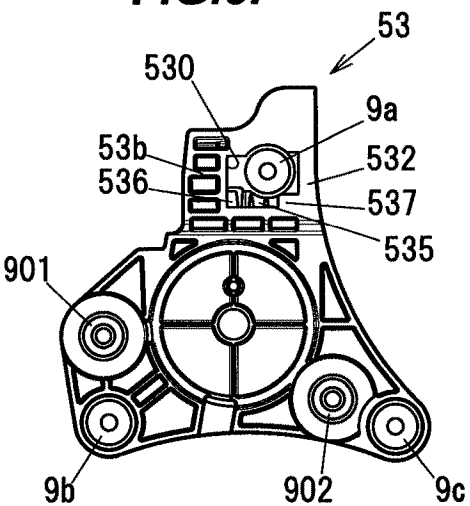

FIGS. 5A to 5F are plan views showing a configuration of the drum housing 53, wherein FIG. 5A is a top view, FIG. 5B is a front view, FIG. 5C is a left side view, FIG. 5D is a right side view, FIG. 5E is a bottom view and FIG. 5F is a back view.

The drum housing 53 has the drum housing portion 531 for accommodating the drum 52, the fitting portion 532 having the fitting hole 532*a* to which the guide rail 2 is fitted, and first to third fixing holes 533*a* to 533*c* used for fastening the motor housing 54. The first fixing hole 533*a* corresponds to "the fastening hole" of the invention.

As shown in FIG. 5B, the drum housing portion 531 is a cylindrical recess which opens on the outer side in the vehicle width direction with respect to the vehicle compartment. A shaft 531*a* protruding in the direction along the rotational axis Q of the drum 52 is provided in the drum housing portion 531 to support the drum 52. First and second guide grooves 531*b* and 531*c* which are in communication with a space for housing the drum 52 are also formed on the drum housing portion 531 so that the ascending-side cable 41 and the descending-side cable 42 wound around the drum 52 are guided and extend out.

Bolt insertion holes 534*a* and 534*b* for inserting the panel attachment bolt 901 and 902 are formed on the drum housing 53 so as to sandwich the drum housing portion 531 in the vehicle longitudinal direction.

The fitting portion 532 of the drum housing 53 has a plate shape having a predetermined thickness in the vehicle width direction and is provided above the drum housing portion 531.

A nut 9*a* is fitted into the first fixing hole 533*a*, and the bolt 81 is threaded into the nut 9*a* from a back surface 53*b* side which is opposite to a front surface 53*a* facing the motor housing 54. Likewise, nuts 9*b* and 9*c* are respectively fitted into the second and third fixing holes 533*b* and 533*c*, and the bolts 82 and 83 are threaded into the nuts 9*b* and 9*c* from the back surface 53*b* side of the drum housing 53.

As shown in FIG. 5A, the fitting hole 532*a* of the drum housing 53 is a hole having a depth in the longitudinal direction of the guide rail 2 and opens on the upper surface of the fitting portion 532. The fitting hole 532*a* is in communication with the first fixing hole 533*a*.

The first to third fixing holes 533*a* to 533*c* are arranged so that the drum housing portion 531 fits within a virtual triangle formed by connecting the respective center points.

The first fixing hole 533*a* is an insertion hole which penetrates the fitting portion 532 in the vehicle width direction and through which the bolt 81 is inserted. The drum housing 53 is configured that the first fixing hole 533*a* is located at a position overlapping the guide rail 2 in the vehicle longitudinal direction. This configuration allows the drum housing 53 to have a smaller size in the vehicle longitudinal direction than when the first fixing hole 533*a* is provided at a position not overlapping the guide rail 2.

As shown in FIG. 5F, on the back surface 53*b* which is opposite to the front surface 53*a* facing the motor housing 54, the drum housing 53 has an opening which opens on the vehicle compartment side in the vehicle width direction and is formed as an insertion hole 530 for inserting the nut 9*a*, which is a fastening member for fastening the motor housing 54 to the drum housing 53, into the first fixing hole 533*a*. The nuts 9*a* to 9*c* are fixed to the first to third fixing holes 533*a* to 533*c* by, e.g., press fitting.

The Insertion Hole 530 of the Drum Housing 53

Figure 6A:
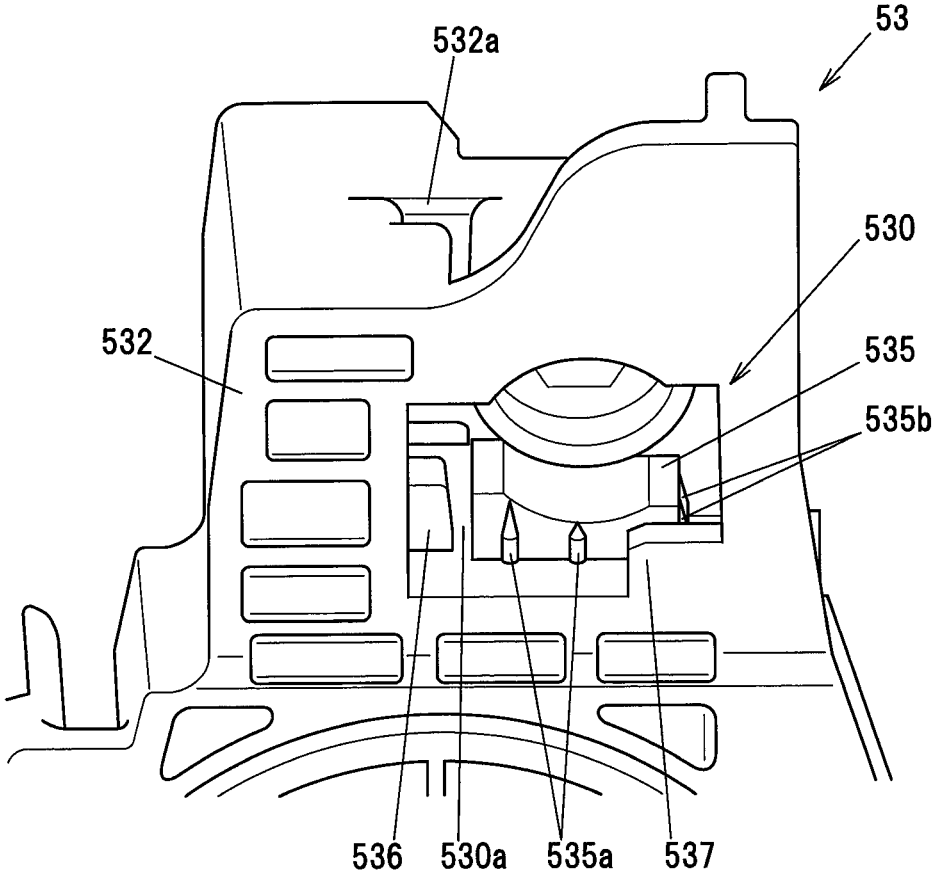
FIG. 6A is an enlarged view showing a portion of the drum housing.
Figure 6B:
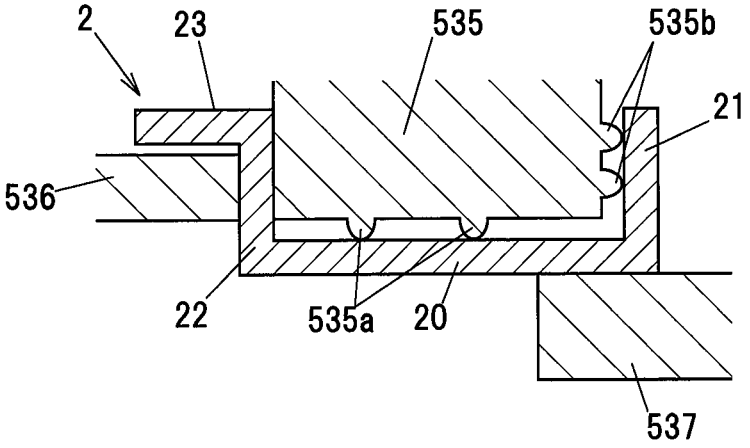
FIG. 6B is a schematic cross-sectional view showing a structure to support a guide rail by the drum housing.

FIG. 6A is an enlarged view showing the insertion hole 530 of the drum housing 53 and the periphery thereof, and FIG. 6B is a schematic cross-sectional view showing a structure to support the guide rail 2 inside the insertion hole 530 of the drum housing 53.

As shown in FIG. 6A, a raised portion 535, a first wall portion 536 and a second wall portion 537 are formed inside the insertion hole 530 of the drum housing 53 in such a manner that the raised portion 535 bulges from a bottom surface 530*a* which is in contact with the lower end of the guide rail 2 fitted to the fitting hole 532*a*, and the first wall portion 536 and the second wall portion 537 are arranged to have a gap from the raised portion 535.

As shown in FIG. 6B, the raised portion 535 is provided with a pair of first protrusions 535*a* in contact with the flat plate portion 20 of the guide rail 2, and a pair of second protrusions 535*b* in contact with the first side plate portion 21 of the guide rail 2.

The first wall portion 536 is arranged so that the second side plate portion 22 of the guide rail 2 is sandwiched between the first wall portion 536 and the raised portion 535. The second wall portion 537 is arranged so that the flat plate portion 20 of the guide rail 2 is sandwiched between the second wall portion 537 and the raised portion 535.

The guide rail 2 is firmly supported inside the insertion hole 530 by the pair of first protrusions 535*a*, the pair of second protrusions 535*b*, the raised portion 535 and the first and second wall portions 536 and 537. The pair of first protrusions 535*a*, the pair of second protrusions 535*b*, the raised portion 535 and the first and second wall portions 536 and 537 form a restricting portion which restricts movement of the guide rail 2 in the vehicle width direction. This configuration also improves attachment strength of the guide rail 2 to the drum housing 53. The number and shape of the portions constituting the restriction portion are not limited thereto as long as a structure capable of supporting guide rail 2 is provided.

Functions and Effects

Next, the functions and effects obtained by the present embodiment will be described in reference to FIG. 7. FIG. 7A is a diagram illustrating a drum housing in Comparative Example and FIG. 7B is an explanatory diagram illustrating the configuration of the drum housing in the present embodiment.

The window regulator 1 in Comparative Example is configured in the same manner as the window regulator 1 in the present embodiment, except that the shape of the drum housing is different from that of the drum housing 53. Constituent elements having substantially the same functions as those described in the present embodiment are denoted by the same reference numerals in in FIG. 7 and the overlapping explanation will be omitted.

As shown in FIG. 7A, a drum housing 53A in Comparative Example has first, second and third fixing holes 533*d*, 533*b* and 533*c* which are used for fastening the motor housing 54. The first fixing hole 533*d* is provided at a position not overlapping the guide rail 2 in the vehicle longitudinal direction. That is, the first fixing hole 533*a* in the present embodiment is provided at a position overlapping the guide rail 2 in the vehicle longitudinal direction as shown in FIG. 7B, but the drum housing 53A in Comparative Example does not have such configuration. In other words, while the drum housing 53 in the present embodiment has the first fixing hole 533*a* provided at a position overlapping the guide rail 2 when viewed in the direction along the width of the vehicle, the drum housing 53A in Comparative Example has the first fixing hole 533*d* provided at a position not overlapping the guide rail 2 when viewed in the direction along the width of the vehicle.

Figure 7B:
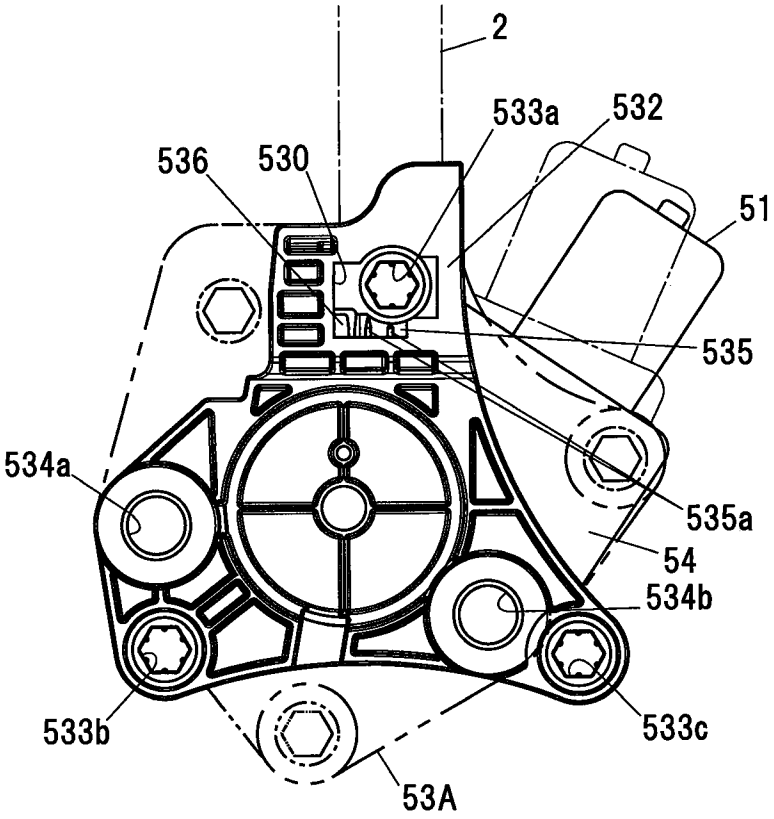
FIG. 7B is an explanatory diagram illustrating the configuration of the drum housing in the embodiment.
Figure 7A:
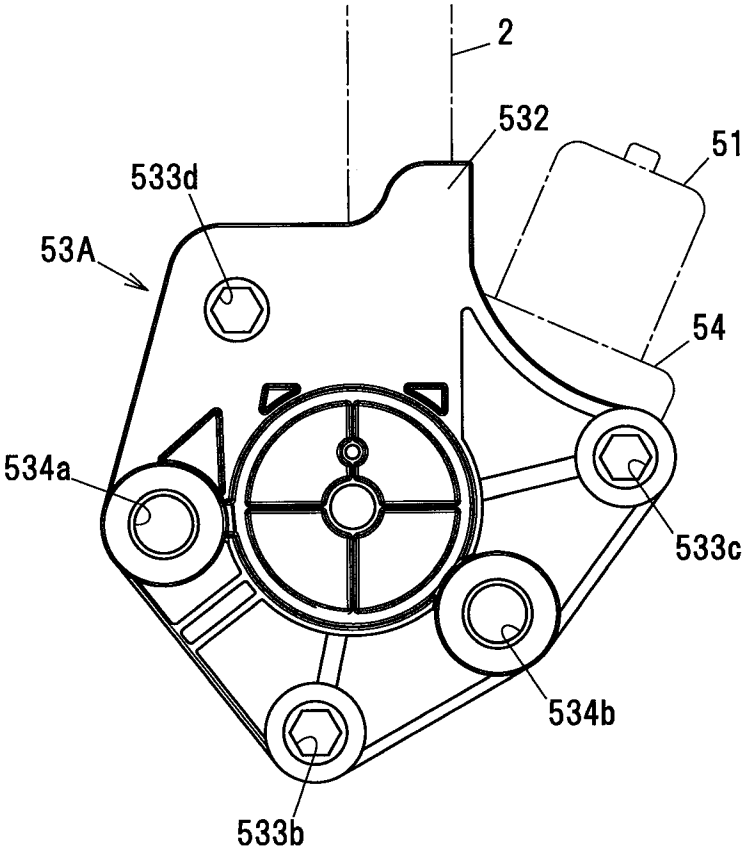
FIG. 7A is a diagram illustrating a drum housing in Comparative Example.

Since the first fixing hole 533*a* is provided at a position overlapping the guide rail 2 in the vehicle longitudinal direction as shown in FIG. 7B, a space required for the drum housing 53A to form the first fixing hole 533*d* in Comparative Example is not required for the drum housing 53, hence, the size of the drum housing 53 can be reduced by the portion required to form the first fixing hole 533*d* (the portion indicated by a dash-dot-dot line in FIG. 7B).

That is, in the present embodiment, it is possible to reduce the weight and size of the drum housing 53.

In case of the window regulator as described above, it is sometimes difficult to have enough clearance for avoiding contact with other parts since a space in door panel for arranging the housing 50 is often limited. In such a case, contact of the motor 51 with other parts is particularly problematic. The problem of arrangement angle of the motor 51 could be solved by arranging the motor housing 54 at a position rotated with respect to the drum housing 53. In practice, however, it is difficult to solve the problem by this method since the arrangement angle of the motor 51 cannot be varied in view of waterproof properties, etc. The problem can be solved by newly designing the motor housing 54, but providing the motor housing 54 with a new configuration causes problems of rising costs. Based on this fact, a window regulator excellent in layout properties is realized in the invention without changing the shape of the motor housing 54 by arranging the first fixing hole 533*a* so as to overlap the guide rail 2 in the vehicle longitudinal direction while preventing contact with other parts by reducing the length of the motor 51 protruding beyond the housing 50.

Although the embodiment of the invention has been described, the invention according to claims is not to be limited to the embodiment. For example, although the insertion hole 530 of the drum housing 53 is a hole for inserting the nut 9*a* as a fastening member used for fastening the motor housing 54 to the drum housing 53, it is not limited thereto. The insertion hole 530 may be provided as a hole for inserting a bolt. In this case, a bolt as a fastening member is inserted into the insertion hole 530 of the drum housing 53 and a nut is attached to the bolt from the motor housing 54 side.

Further, it should be noted that all combinations of the features described in the embodiment are not necessary to solve the problem of the invention. The invention can be appropriately modified and implemented without departing from the gist thereof.

What is claimed is:

1. A window regulator, comprising:

a guide rail provided along both an ascending direction and a descending direction of a window of a vehicle;

a carrier plate that slides on the guide rail and moves together with the window;

a drive unit comprising a drum rotationally driven by a motor;

cables that pull the carrier plate, and a housing that comprises a drum housing accommodating the drum and a motor housing fixed to the drum housing and accommodating a portion of the motor, wherein the drum housing comprises a fitting portion comprising a fitting hole into which a lower end of the guide rail is inserted and a fastening hole that comprises a first fastening member used to fasten the motor housing to the drum housing, wherein the motor housing comprises a bolt insertion hole for inserting a second fastening member fixed to the first fastening member, wherein the motor housing and the drum housing are fastened by thread of the first fastening member and the second fastening member, wherein the drum housing further comprises an opening that opens on a surface opposite to a surface facing the motor housing, the opening being formed at a position facing the fastening hole in a direction along a width of the vehicle, and wherein the fastening hole of the drum housing is provided at a position overlapping the guide rail in a longitudinal direction of the vehicle.

2. A window regulator, comprising:

a guide rail provided along both an ascending direction and a descending direction of a window of a vehicle;

a carrier plate that slides on the guide rail and moves together with the window;

a drive unit comprising a drum rotationally driven by a motor;

cables that pull the carrier plate;

a housing that comprises a drum housing accommodating the drum and a motor housing fixed to the drum housing and accommodating a portion of the motor, wherein the drum housing comprises a fitting portion comprising a fitting hole into which a lower end of the guide rail is inserted and a fastening hole that comprises a first fastening member used to fasten the motor housing to the drum housing, wherein the fastening hole of the drum housing is provided at a position overlapping the guide rail in a longitudinal direction of the vehicle, wherein the drum housing further comprises an opening that opens on a surface opposite to a surface facing the motor housing, and wherein the opening is formed as an insertion hole to insert a fastening member that is used to fasten the motor hosing to the drum housing inside the opening thereof, and a restricting portion to restrict movement of the guide rail in a direction along the width of the vehicle so as to be raised from a bottom surface of the fitting hole, the bottom surface being in contact with the lower end of the guide rail.

3. The window regulator according to claim 2, wherein the restricting portion is provided with portions in contact with the guide rail.

* * * * *